US005195801A

United States Patent [19]

Franck et al.

[11] Patent Number: 5,195,801

[45] Date of Patent: Mar. 23, 1993

[54] TILTABLE CHAIR

[75] Inventors: Klaus Franck, Hanover; Werner Sauer, Springe, both of Fed. Rep. of Germany

[73] Assignee: Wilkhahn Wilkening & Hahne GmbH & Co., Fed. Rep. of Germany

[21] Appl. No.: 782,898

[22] Filed: Oct. 24, 1991

Related U.S. Application Data

[63] Continuation of Ser. No. 457,296, Dec. 26, 1989, abandoned.

[30] Foreign Application Priority Data

Jan. 5, 1989 [DE] Fed. Rep. of Germany ..... 3900220

[51] Int. Cl.[5] ..... A47C 3/00

[52] U.S. Cl. ..... 297/301; 297/300

[58] Field of Search ..... 297/300–304, 297/316

[56] References Cited

U.S. PATENT DOCUMENTS

| | | | |
|---|---|---|---|
| 1,538,408 | 5/1925 | Reed | 297/301 X |
| 4,502,729 | 3/1985 | Locher | 297/300 X |
| 4,509,793 | 4/1985 | Wiesmann et al. | 297/300 X |
| 4,682,814 | 7/1987 | Hansen | 297/300 |
| 4,709,962 | 12/1987 | Steinmann | 297/301 |
| 4,744,600 | 5/1988 | Inoue | 297/300 X |
| 4,761,033 | 8/1988 | Lanuzzi et al. | 297/301 X |
| 4,773,706 | 9/1988 | Hinrichs | 297/300 |
| 4,792,187 | 12/1988 | Desanta | 297/300 |
| 4,804,227 | 2/1989 | Hansen | 297/300 |

FOREIGN PATENT DOCUMENTS

| | | | |
|---|---|---|---|
| 8616836 | 12/1987 | Fed. Rep. of Germany | 297/300 |
| 2627968 | 9/1989 | France | 297/345 |

*Primary Examiner*—Jose V. Chen

*Attorney, Agent, or Firm*—Learman & McCulloch

[57] ABSTRACT

A tiltable chair in which a back rest is supported by at least one rear lever via a swivel joint and the seat is supported by a resilient, flexible front mounting element on a pedestal in such a way that when the back rest is tilted forwards or backwards the seat simultaneously partakes of an approximately horizontal, linear movement and the rear part of the seat partakes of a greater lifting or lowering movement than the front part of the seat.

21 Claims, 4 Drawing Sheets

TILTABLE CHAIR

This is a continuation of copending application Ser. No. 07/457,296 filed on Dec. 26,1989, now abandoned.

The invention relates to a chair, and more particularly an office swivel chair.

BACKGROUND OF THE INVENTION

Charirs are known (for instance from DE-A-30 36 993) which can be used in particular as office swivel chairs and have a so-called "synchronising mechanism". These chairs react automatically or after actuation of a release means in such a way that when the user leans back the seat is lowered slightly and the back is inclined more sharply backwards, whilst the front edge of the seat remains approximately the same distance from the floor. This movement of the resulting opening of the angle between the seat and the back rest approximates the natural course of the movement of the human body. If the user again moves out of the leaned-back position into an upright working position, then the chair automatically follows by means of a spring mechanism fixed below the seat. Such changing of position facilitates adaptation to different activities at the workplace and are regarded by ergonomists and workplace doctors as preventive measures against the consequences to health of sedentary office work.

A chair disclosed in German application No. P 37 37 491.5 has a front lever connected via two swivel joints to a pedestal and the seat, whilst a rear lever is also connected via two further swivel joints to the pedestal and the seat, this rear lever having an extension which bears the back rest and projects over the fourth swivel joint. In this construction of the chair relative positions of the plane of connection between the first and second swivel joints with respect to the vertical on the one hand and of the plane of connection between the third and fourth swivel joints with respect to the vertical on the other hand should ensure favourable seat positions and changes of position.

Furthermore, a chair construction is also known from EP-A-250 207 in which at least one rear lever is connected on the one hand via a first swivel joint to the pedestal and on the other hand via a second swivel joint to the rear end of the seat, whilst at least one front lever is connected via a third swivel joint to the pedestal and via a fourth swivel joint to the front end of the seat. A spring system is arranged between the central column of the pedestal and the fourth swivel joint at the front end of the seat.

The object of the invention is to make further improvements to a chair of the type referred to and in such a way that it is adapted particularly easily and well to the natural movement of a person at a desk and is distinguished above all by a relatively simple design.

SUMMARY OF THE INVENTION

In the practical construction of a chair according to the invention a user can first of all in an extremely advantageous manner carry out a very natural and casual movement between the individual positions. Thus in the neutral position, i.e. in the normal or unadjusted position of the back-rest and seat, angles of approximately 90° are produced between the upper part of the body and the thigh, as well as between the thigh and the lower leg and between the lower leg and the floor. By contrast, in the position where the user is leaning back the angle between the upper part of the body and the thigh opens, the pelvis is lowered, the angle between the thigh and the lower leg remains approximately 90° and a slightly obtuse angle is produced between the lower leg and the foot or floor. Furthermore, in the position where the user is leaning forward the pelvis is raised, so that an unpleasant constriction between the trunk and the thigh is avoided; by contrast a slightly acute angle is produced between the lower leg and the foot.

Thus this chair according to the invention facilitates changing of position which is largely adapted to the natural course of movement of the human body. The seat of the chair moves about a virtual centre of rotation which lies far below the resulting mechanical centres of rotation or axes of rotation.

In this case it is of particular importance that these ideal kinematics of the chair can be achieved by extremely simple constructive means, i.e. it can be sufficient therefor if the rear lever or each rear lever bearing the back rest is connected by its lower end via only one swivel joint to the pedestal, and the front connecting element or each such element between the front half of the seat and the pedestal can be formed by a relatively simple element of limited flexibility which with a very simple construction and arrangement prestresses the seat extremely effectively during a deflection movement of the back rest in the direction of its central neutral position. The good kinematics of this chair are also assisted by the construction and arrangement of the rear lever.

THE DRAWINGS

The invention will be explained below with the aid of several embodiments which are illustrated in the drawings. Some of these drawings have been kept very schematic, and in them:

Figure 1:
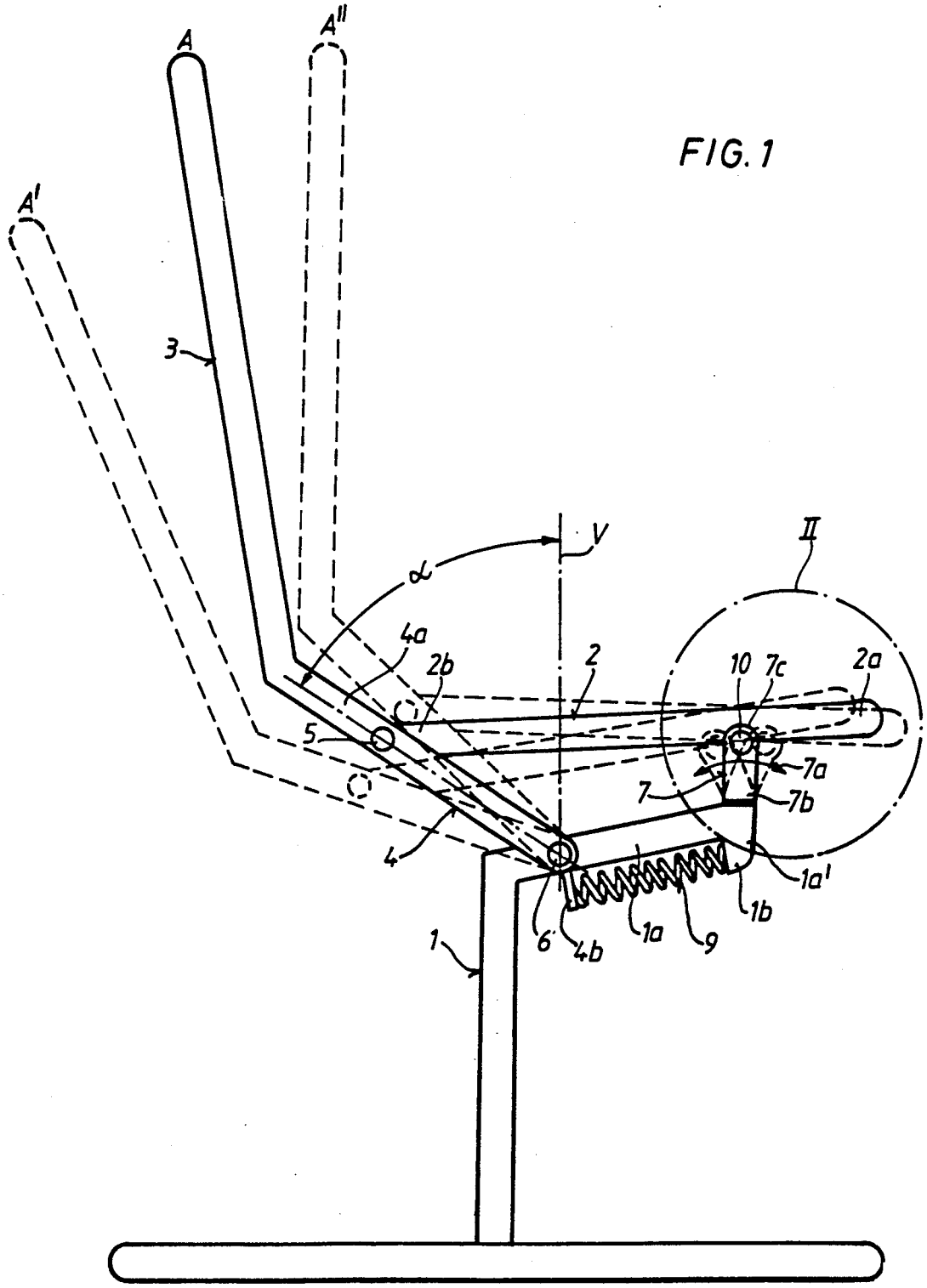
FIG. 1 shows a side view of the chair in the form of an office swivel chair, with three different seat positions indicated.
Figure 5:
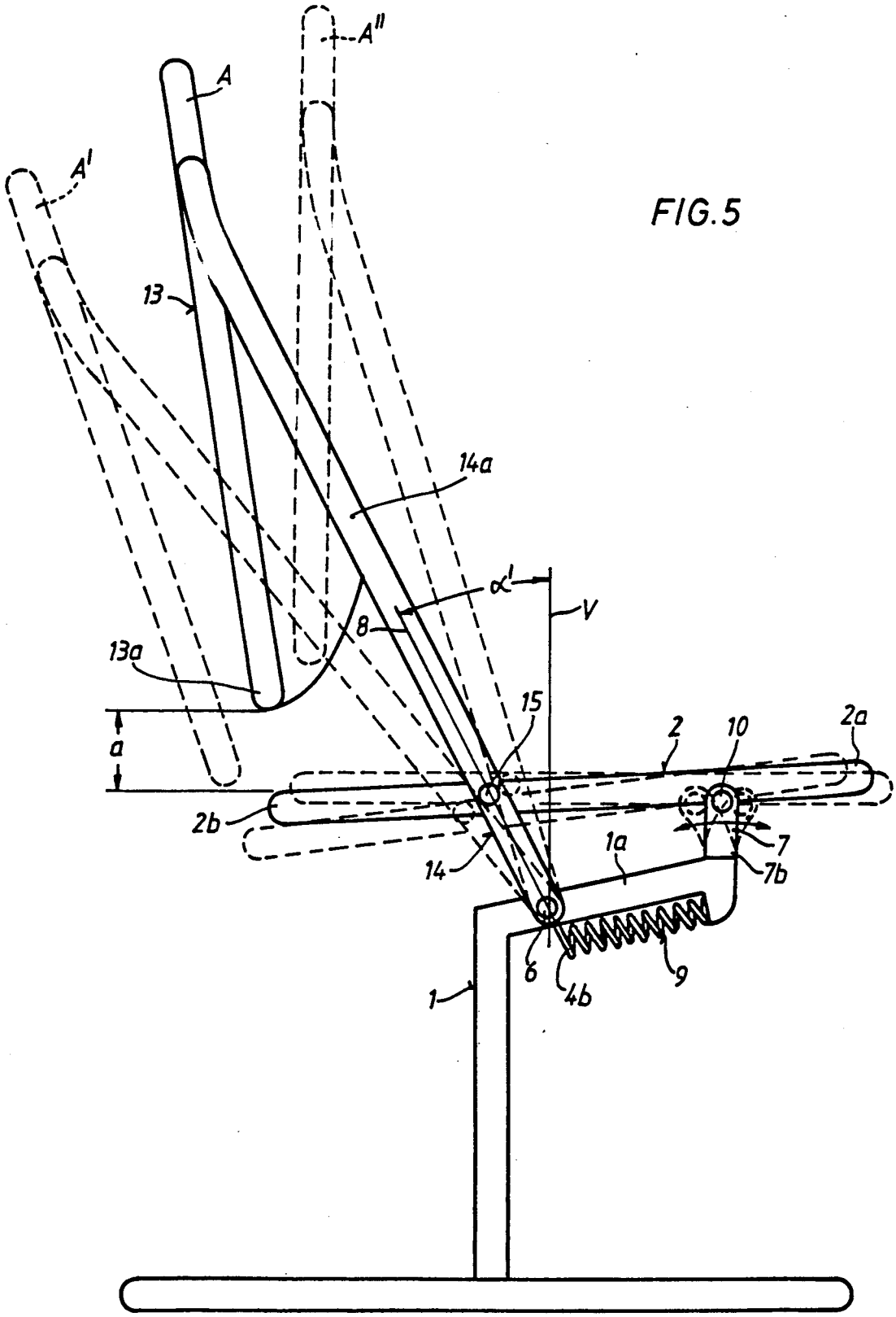
Figure 6:
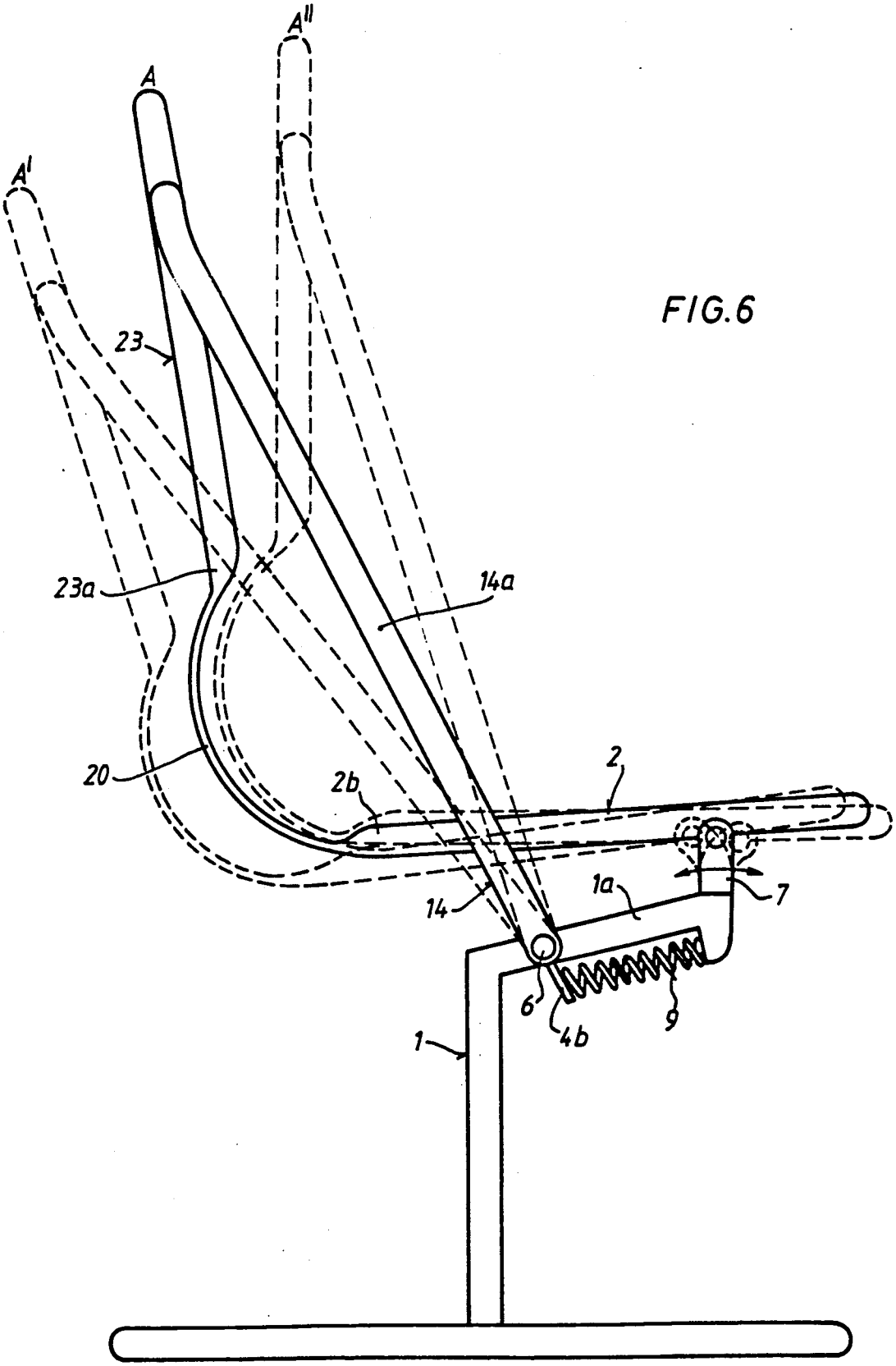

FIGS. 5 and 6 each show a similar side view to FIG. 1, but of two other variants of the chair.

The first embodiment of the chair which is constructed in particular as an office swivel chair will be explained first of all with the aid of the illustration in FIG. 1. Here the chair is shown in three different seat positions; the representation with solid lines shows the neutral position A corresponding to the unstressed or normal position, the representation shown by broken lines and inclined towards the left in the drawing shows the maximum leaned-back position A', and the represented shown by broken lines and inclined towards the right in the drawing shows the maximum leaned-forward position A".

The illustrated office swivel chair contains a pedestal 1 which can have a central column (swivel column) as well as optionally backing or roller bearings, and in addition a seat 2 and a back rest 3.

In this embodiment (FIG. 1) the chair also has at least one rear lever 4 provided between the pedestal 1 and the back rest 3. This rear lever, 4 is connected to the seat 2 via a swivel joint 5 at a point which is located at the rear end of the seat and forms a swivel joint connection between the seat 2 and the back rest 3. The lower end of this rear lever 4 is connected via a swivel joint 6 to the pedestal 1, preferably in the present case to an upper end 1a which is bent forwards at an angle. In this case the rear lever 4—starting from the lower first swivel joint 6—is extended in a straight line towards the rear/-top beyond the second swivel joint 5 (at the rear end of the seat 2), this extension 4a of the lever 4 bearing the back rest 3 and being firmly connected thereto.

At least one front mounting element 7 connects the underside of the seat 2 to the pedestal 1 (preferably with the foremost end 1a' of the upper angled end 1a of the pedestal 1. Whereas the rear lever 4 is a rigid mounting element, this front connecting element 7 is formed by a resilient flexible, springy flexure, element which is capable of limited deformation, or bending and which prestresses or biases the seat 2 in each case in the direction of its neutral position A during a deflection in one or the other direction, as shown in FIG. 1 by the three different positions A, A' and A" and as indicated by a double arrow 7a.

The flexible front mounting element 7 can generally be rigidly clamped at one end and can be connected at its other end via a swivel joint. What is most particularly advantageous and therefore preferred is an arrangement of this flexible front element 7 in such a way that its lower end 7b is rigidly clamped on the pedestal 1 or on the bent front end 1a thereof and is connected at its upper end 7c to the seat 2 via a swivel joint 10. This connecting swivel joint 10 is generally located in the front third of the seat 2. The construction and arrangement of this front connecting element 7 thus facilitates and controls a limited relative movement between the seat 2 and the pedestal 1.

Figure 2:
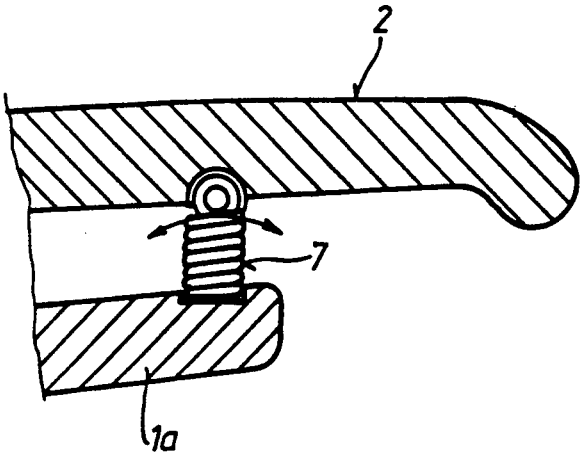
FIG. 2–4 show three detail sectional views (for instance section II in FIG. 1) of the front seat region of the chair, in order to explain several different embodiments of the front maintaining element.
Figure 3:
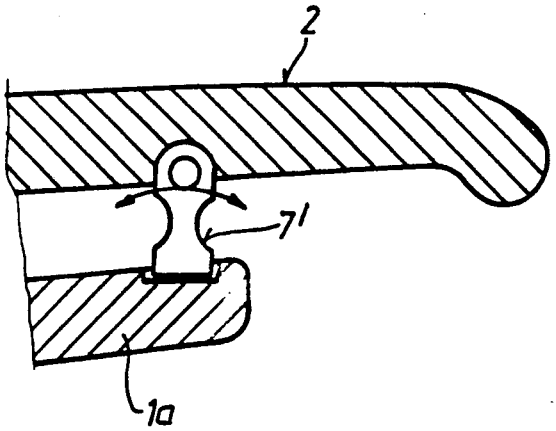
Figure 4:
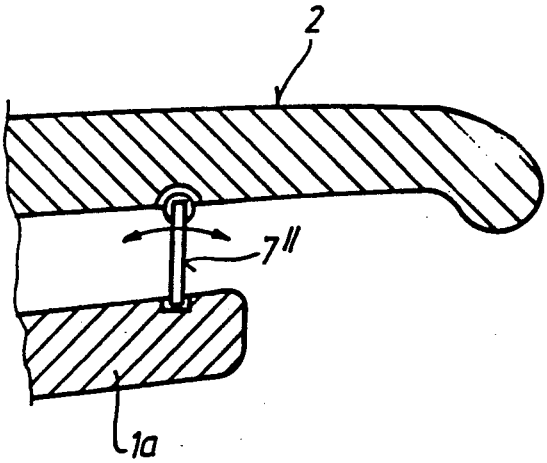

As is shown in FIGS. 2, 3 and 4, the front mounting element 7 with limited flexibility can be of various different constructions in any suitable manner.

According to FIG. 2 it may be assumed that this front element 7 is formed by a spiral tension spring. According to FIG. 3 this front element 7' can be constructed in the form of a buffer element made from rubber or rubber-like plastic. Furthermore, FIG. 4 shows a construction according to which the front element is constructed in the form of an upright leaf spring element 7".

In the case of all embodiments according to these FIGS. 2-4 the corresponding front element 7, 7' or 7" respectively, which is preferably produced individually in each case, is rigidly clamped in each case with its lower end on the pedestal 1 or 1a and connected via its upper end to the underside of the seat 2 by means of a suitable swivel element, as shown with the aid of FIG. 1. In general, these connections could of course also be made by other suitable means, for example by hooking, clamping, screwing etc., in which case it is also preferable for the or each element 7, 7' or 7" to be replaceable.

Depending upon the size and construction, it is possible for only one single front element of the type described to be provided. In practice, however, it is generally preferred to arrange several such flexible front elements, preferably two or three, adjacent to one another, i.e. behind one another at right angles to the drawing plane with reference to the various figures of the drawings, because the individual elements can then be of relatively small and space-saving construction and can at the same time can also provide for an improved directional stability (forwards-backwards movement).

With reference again to the embodiment of the swivel chair illustrated in FIG. 1 it will be seen first of all that the first swivel joint 6 connects the lower end of the rear lever 4 to the upper end of the actual vertical central column of the pedestal 1, whereas the second swivel joint 5 of the rear lever 4 is articulated on the rear end 2b of the seat 2. The upper end of the front element 7 is connected approximately—as already mentioned—to the front third of the seat 2, i.e. the connecting swivel joint 10 is offset somewhat to the rear with respect to the front end 2a of the seat.

The distance between the second swivel joint 5 and the upper end 7c of the front element 7 connected to the seat 2 via the swivel joint 10 amounts to approximately 1.5 to 2.5 times, preferably approximately 2 times the distance between the first swivel joint 6 and the connection of the lower end 7b of the front element 7 to the pedestal.

Whereas the flexible front element 7 is aligned substantially vertically, the plane of connection 8 extending between the first and second swivel joints 6, 5 of the rear lever 4 in the neutral position A is inclined backwards with respect to the vertical V by an angle $\alpha$ between 40° and 70°, preferably 60°.

The maximum rearward; deflection of the back rest 3 (position A') out of the neutral position A amounts to approximately 20° and forwards (position A") out of the neutral position amounts to approximately 10°.

In this first embodiment illustrated in FIG. 1 the rear lever 4 is preferably constructed as a part of the back rest 3; on the other hand, the front element 7 can be constructed—as explained above with the aid of FIGS. 2 to 4—as an individual, preferably replaceable flexible element.

In the neutral position A the seat 2 and the back rest 3 take up—as mentioned—the neutral position shown by solid lines. If the user then leans back in the chair, then the back rest 3 tilts backwards about the lower first swivel joint 6, for example into the maximum rear position A'. In this case the seat simultaneously carries out an approximately horizontal linear fore and aft movement as well as a greater lowering movement in the rear seat part than in the front seat part—in each case relative to the pedestal, which is effected and controlled by the combined control-spring system formed by the rear lever 4 and the front element 7.

The distance of the front end of the seat 2a from the floor increases only slightly in the course of this. The angle between the upper part of the body and the thigh of the user opens during this backward movement, and at the same time the pelvis is lowered. The angle between the thigh and the lower part of the leg remains approximately 90°, whereas a slightly obtuse angle is produced between the lower part of the leg and the foot.

If the user moves forwards out of the neutral position A, for example into the maximum forward position A" shown by broken lines, then the back rest 3 becomes upright and the seat 2 moves forwards, i.e. in the approximately horizontal movement of the seat 2 the rear seat part carries out a greater lifting movement than the front seat part (again relative to the pedestal 1). The user's pelvis is raised, which prevents an unpleasant constriction between the trunk and the thigh. A slightly acute angle is produced between the lower part of the leg and the foot.

Furthermore, as is indicated only simply in FIG. 1, the lower end of the rear lever 4 which is articulated on the first swivel joint 6 is connected to a suitable spring system 9 which is indicated in this FIG. 1 as a spiral spring. For this purpose the lower end of the rear lever 4 has an approximately lever-like projection 4*b* which projects downwards over the first swivel joint 6 and to which one end of the spring system is connected. Whilst the other end thereof is held on a fixed projection 1*b* which also projects downwards on the upper end 1*a* which is bent forwards of the pedestal 1.

Generally this spring system 9 can be constructed in any suitable manner which is known per se, for example as a compression spring system, as spring rods, as leg springs, leaf springs, torsion springs or also as gas springs. In this case this spring system should produce restoring forces which exert a counter-pressure on the seat 2 and the back rest 3 when a deflection of the seat and back rest is caused by a corresponding body movement of the user.

FIG. 5 shows a construction which varies somewhat from the embodiment described previously, the differences being in particular in the co-ordination of the seat, rear levers and back rest, whilst the possible constructions of the other parts can be kept substantially unchanged, so that the same references as in FIG. 1 are used in this variant according to FIG. 5 to designate parts which are of the same construction, and as a result it is largely unnecessary to describe these parts again.

As in the first embodiment, here too the seat 2 is connected to the upper end 1*a* of the pedestal through the underside of its front third by means of at least one front mounting element 7 of limited flexibility (construction and arrangement similar to that described on the basis of FIGS. 1–4).

In this example (FIG. 5), however, two rear levers 14 are arranged in a pair and approximately parallel to one another on either side of the seat 2 and the back rest 13. In this case the rear end 2*b* of the seat 2 juts out to the rear over the second swivel joint 15 and beyond the rear lever 14. Furthermore, the lower region 13*a* of the back rest 13, which in this case is curved towards the rear in a manner which is known per se, is a clear distance a from the seat 2 in the neutral position A shown by solid lines, whilst in the rear position A′ of the back rest 13 shown by broken lines it is lowered and located a shorter distance above the seat 2, as can be clearly seen in FIG. 5. In addition the lateral frame parts of the back rest 13 can be arranged as an approximately straight extension of the rear lever 14, i.e. in this case the extensions 14*a* of the two rear levers 14 which project in a substantially straight line towards the rear/top beyond the second swivel joint 15 merge directly into the back rest 13, at least in the side view.

Referring again to the plane 8 between the swivel joints 15 and 6 in this embodiment according to FIG. 5, in this case in the neutral position A the plane 8 is inclined with respect to the vertical V by an angle $\alpha'$ between 15° and 40°, preferably by approximately 25°, towards the rear, that is to say therefore that the plane 8 between the swivel joints 15 and 6 of the two rear levers 14 runs more steeply than in the case of FIG. 1.

Finally, if the distance ratios between the two rear levers 14 and the flexible front mounting element 7 are compared, then in the case of FIG. 5 the distance between the second swivel joint 15 and the connecting swivel joint 10 at the upper end of the element 7 approximately 1.2 to 1.8, preferably 1.4, times the distance between the first swivel joint 6 and the lower end 7*b* of this front connecting element 7.

Otherwise, in the example of FIG. 5 a similar spring system 9 can also be clamped between the lower end of at least one rear lever 14 and the pedestal 1, as described in FIG. 1.

In the neutral position of this chair construction (FIG. 5) the seat 2 and the back rest 13 also take up approximately the position A. If the user leans back in the chair, then the back rest 13 and the first swivel joint 6 tilt backwards, at most as far as approximately the position A′. The seat 2 simultaneously carries out an approximately horizontal movement backwards as well as a greater lowering movement in its rear part 2*b* (in comparison to the lifting movement in the front seat part) relative to the pedestal 1, which is again effected and controlled by the control-spring system formed by the lever pair 14 and the flexible front element 7. In this case too the distance of the front edge 2*a* of the seat 2 from the base only increases slightly. The angle between the upper part of the body and the thigh opens during the backward movement, and at the same time the user's pelvis is lowered. The angle between the thigh and the lower leg remains approximately 90°, and a slightly obtuse angle is produced between the lower leg and the foot.

If the user moves forwards out of the neutral position A, at maximum as far as the position A″, then the back rest 13 becomes upright and the seat 2 moves forwards. The pelvis is raised slightly, which prevents an unpleasant constriction between the trunk and the thigh. A slightly acute angle is produced between the lower leg and the foot (again, all as in the example of FIG. 1).

Finally, FIG. 6 shows a further variant of the office swivel chair, particularly a simplified variant of the embodiment last described above in connection with FIG. 5, so that the same reference numerals as in FIGS. 5 or 1 can be used in this FIG. 6 for parts of similar construction and for the most part these parts do not need to be described again in detail.

The two rear levers 14 which are extended approximately towards the rear/top are again held as a pair and approximately parallel to one another on both sides of the seat 2 and the back rest 23 by the upper sections of the lever extensions 14*a* in a similar manner to that described in the preceding example (FIG. 5).

In the present case (FIG. 6), however, the rear end 2*b* of the seat 2 and the lower end 23*a* of the back rest 23 are connected to one another in one piece by a flexible connecting piece 20 which is curved towards the rear (outwards), i.e. in this case the back rest 23 is rigidly connected to the upper lever extensions 14*a* and connected—by means of the rearwardly curved connecting piece 20—to the rear end 2*b* of the seat 2 for sprung movement.

Because of this integral connection for sprung movement between the seat 2 and the back rest 23 the seat 2 in this variant only needs to be supported via the flexible front connecting element 7 directly on the pedestal 1 or its upper end 1*a* which is bent forwards, i.e. the seat 2 or the front half thereof (preferably the front third thereof) only has one direct supporting connection to the pedestal 1 or 1*a* by means of the flexible front element 7. Naturally, as explained above in connection with FIGS. 1–4, several such flexible front elements 7 can be provided beside one another in a suitable construction and arrangement.

In this case the pair of rear levers 14 is only connected at the lower lever ends via the first, lower joint 6 to the upper end of the pedestal 1 (just as in the preceding examples), whereas the second joint (between these rear levers 14 and the seat 2) which is provided in the preceding embodiments cannot be omitted.

The course of movement during use of this variant of the office swivel chair is practically similar to that described above in connection with FIGS. 1 and 5, so that it is only necessary here to refer to the central neutral position A and to the maximum rear and front positions A' and A" respectively in FIG. 6.

Thus in all the variants of the chair according to the invention the seat and the back rest are mounted on the pedestal by means of at least one flexible front mounting element and at least one lever via at least one swivel joint in such a way that when the back rest is tilted forwards or backwards the seat simultaneously carries out an approximately horizontal linear movement with the rear part of the seat carrying out a greater lifting or lowering movement than the front part.

We claim:

1. A chair construction comprising a pedestal member; a seat member having a forward end and a rearward end; a back rest having an upper end and a lower end; means connecting said back rest to said pedestal member for rocking movements of said back rest about a substantially horizontal first axis; means coupling said seat member to said back rest; and flexible and resilient mounting means connecting said seat member to said pedestal member, the flexibility of said mounting means enabling said mounting means to deform from an unstressed condition an amount sufficient to enable said seat member simultaneously to rock about a second substantially horizontal axis and move endwise between forwardmost and rearwardmost positions in response to said rocking movements of said back rest about said first axis, the resilience of said mounting means constantly biasing said mounting means toward said unstressed condition.

2. The construction according to claim 1 wherein said mounting means comprises a springy member fixed at one end to one of said members and pivoted at its opposite end to the other of said members.

3. The construction according to claim 2 wherein said one of said members is said pedestal member.

4. The construction according to claim 2 wherein said springy member comprises a spiral tension spring.

5. The construction according to claim 2 wherein said springy member comprises a buffer formed of rubbery material.

6. The construction according to claim 2 wherein said springy member comprises a leaf spring.

7. The construction according to claim 1 wherein the means coupling said seat member to said back rest is pivotal.

8. The construction according to claim 1 wherein the means coupling said seat member to said back rest comprises a flexible member joined to said seat member at its rearward end and to said back rest at its lower end.

9. The construction according to claim 1 wherein the means connecting said back rest to said pedestal member comprises a lever pivoted at one end to said pedestal member and joined at its opposite end to said back rest, and wherein the means coupling said seat member to said back rest comprises a swivel joint connecting said seat member to said lever at a point between its ends.

10. The construction according to claim 9 wherein the distance between said point and said first axis is between 1.5 and 2.5 times the distance between the connection of said lever to said pedestal member and the connection of said mounting means to said pedestal member.

11. The construction according to claim 9 wherein the distance between said point and said first axis is about 2 times the distance between the connection of said lever to said pedestal member and the connection of said mounting means to said pedestal member.

12. The construction according to claim 9 wherein said lever is joined to said seat member at the rearward end thereof.

13. The construction according to claim 9 wherein the distance between said point and said first axis is between 1.2 and 1.8 times the distance between the connection of said lever to said pedestal member and the connection of said mounting means to said pedestal member.

14. The construction according to claim 9 wherein the distance between said point and said first axis is about 1.4 times the distance between the connection of said lever to said pedestal member and the connection of said mounting means to said pedestal member.

15. The construction according to claim 9 wherein the rearward end of said seat extends rearwardly beyond said point.

16. The construction according to claim 9 wherein the position of the lower end of said back rest varies in response to rocking movements of said back rest about said first axis.

17. The construction according to claim 16 wherein the lower end of said back rest is at all times above the level of the rearward end of said seat member and wherein the distance between the lower end of said back rest and the rearward end of said seat member is minimum when said back rest has been rocked to its maximum rearward position.

18. The construction according to claim 9 wherein the connections between said seat member and said back rest to said pedestal member define a plane forming an angle of between about 15° and 40° to the vertical.

19. The construction according to claim 18 wherein said angle varies in response to rocking of said back rest about said first axis.

20. The construction according to claim 9 wherein the connections between said seat member and said back rest to said pedestal member define a plane forming an angle of between about 40° and 70° to the vertical.

21. The construction according to claim 1 wherein said mounting means yieldably biases said seat member to a neutral position between its rearmost and forwardmost positions of adjustment.

* * * * *